US006460229B1

(12) United States Patent
Schulte

(10) Patent No.: US 6,460,229 B1
(45) Date of Patent: Oct. 8, 2002

(54) PRESSURE-SENSITIVE FASTENING PART

(75) Inventor: Axel Schulte, Holzgerlingen (DE)

(73) Assignee: Gottlieb Binder GmbH & Co., Holzgerlingen (DE)

( * ) Notice: Subject to any disclaimer, the term of this patent is extended or adjusted under 35 U.S.C. 154(b) by 0 days.

(21) Appl. No.: 09/700,423

(22) PCT Filed: May 15, 1998

(86) PCT No.: PCT/EP98/02886

§ 371 (c)(1),
(2), (4) Date: Feb. 8, 2001

(87) PCT Pub. No.: WO99/59441

PCT Pub. Date: Nov. 25, 1999

(51) Int. Cl.[7] ..... A44B 18/00
(52) U.S. Cl. ..... 24/448; 24/306; 24/451
(58) Field of Search ..... 24/448, 451, 306

(56) References Cited

U.S. PATENT DOCUMENTS

| | | | | | |
|---|---|---|---|---|---|
| 3,900,648 | A | * | 8/1975 | Smith | 5/361 B |
| 3,952,383 | A | * | 4/1976 | Moore et al. | 24/265 R |
| 4,470,857 | A | * | 9/1984 | Casalou | 24/306 |
| 4,933,224 | A | * | 6/1990 | Hatch | 24/306 |
| 5,464,494 | A | * | 11/1995 | Bolte et al. | 156/330 |
| 5,598,610 | A | | 2/1997 | Torigoe et al. | |
| 5,612,113 | A | * | 3/1997 | Irwin, Sr. | 428/95 |

FOREIGN PATENT DOCUMENTS

| | | | | |
|---|---|---|---|---|
| DE | 195 10 942 A | | 10/1995 | |
| EP | 0 429 249 A | | 5/1991 | |
| EP | 0 461 777 A | | 12/1991 | |
| EP | 0612485 | * | 6/1993 | 24/448 |
| EP | 0 809 952 A | | 12/1997 | |
| WO | WO 95/03723 | | 2/1995 | |
| WO | WO 96/19338 | | 6/1996 | |

OTHER PUBLICATIONS

Certified English Language translation of International Preliminary Examination Report (PCT/IPEA/409) PCT/EP98/02886.
Translation of International Preliminary Examination Report (PCT/IPEA/409) PCT/EP98/02886.
Notification of Transmittal of Copies of Translation of the International Preliminary Examination Report (PCT/IB/338) PCT/EP98/02886.

* cited by examiner

*Primary Examiner*—Victor Sakran
(74) *Attorney, Agent, or Firm*—Smith, Gambrell & Russell, LLP

(57) ABSTRACT

An adhesive closure part for foaming with upholstery parts of vehicle seats during their production comprising a substrate with a plurality of adhesive elements. A bonding agent produces a bonding with the pertinent foam material. The bonding agent is made of an adhesive that is selected to accommodate when the adhesive closure part is made of either a polyamide or a polyolefin material.

17 Claims, 1 Drawing Sheet

PRESSURE-SENSITIVE FASTENING PART

Figure 1:
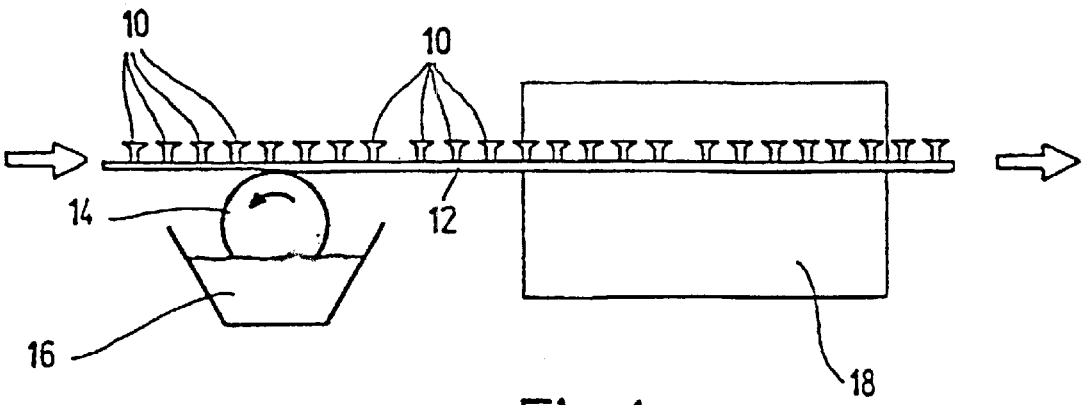

Applicant hereby claims the benefit of International Application No. PCT/EP/02886 filed May 15, 1998, relating to the above-identified U.S. patent application, and is incorporated in its entirety herein.

The invention concerns an adhesive closure part, in particular, for the foaming of upholstery for vehicle seats during their production, with adhesive elements on one side for linkage with corresponding adhesive elements of another adhesive closure part, by formation of an adhesive closure, and with a linking device on the other side of the adhesive closure part for the production of a linkage with the pertinent foam material.

Such adhesive closure parts are known from EP 0 612 485, wherein the adhesive closure part is placed in a foaming mold in such a way that the linking device in the form of loop elements on the backside of the adhesive closure part comes into contact with the pertinent foam material, so as to produce a firm linkage with it. The opposite front side of the adhesive closure part has adhesive elements in the form of linking hooks, adhesives heads, or the like, which are protected from the penetration of foam material, for example, as described in the European document, in that they are surrounded on their entire surface by an uncrosslinked thermoplastic. If after the foaming process in the mold and the removal of the foamed part, the cover is removed, the adhesive elements are free and can later be joined with adhesive elements of another adhesive closure part, for example, in the form of a loop strip, with the formation of a common adhesive closure.

In this way, it is possible to affix, for example, upholstery covering materials to the foamed upholstery parts of a vehicle seat or an airplane seat or to join rotating components, for example, in the form of grinding wheels to tool holding fixtures, in conventional grinders and apparatuses. The aforementioned foam material can definitely be highly fluid, as a function of the object to be formed and can have viscosities which are in the range of water or below. It has become evident that when using looping and noose-like material as a fastener or even when using a nappy cloth or the like, the nooses, which are in fact open, are not completely penetrated by the foam material, but rather form a kind of barrier for it which inhibits the penetration of the foam material. In the subsequent hardening or baking process for the foam material, there are voids, that is, gaslike hollow occlusions, which work against a firm bonding between the adhesive closure part and the foam material at the transition sites between the looping material and the foam. As a result of such a reduced strength of the bonding between the adhesive closure part and foam material, there is a loosening of the bonding with continuous stresses, and the adhesive closure part tears out of the foam material, which can lead to the lack of usefulness of the entire component, for example, in the form of a vehicle seat or a grinding disk holding fixture.

On the basis of this state of the art, the goal of the invention is to further improve an adhesive closure part of the type mentioned in the beginning in such a way that a reliable and very strong bonding between the adhesive closure part and the foam material used can be attained. Such a goal can be attained by an adhesive closure part with the features of Claim 1.

Due to the fact that in accordance with the characterizing section, the bonding agent is made of an adhesive base, applied on the other side of the adhesive closure part, a kind of primer layer is formed on the adhesive closure part, and this layer enters into a very strong bonding with the pertinent foam material and thus guarantees a reliable, hard-to-undo bonding between the adhesive closure part and the later foam body.

To a specialist in the field of adhesive closures and foaming technology, it is surprising that by the application of the adhesive base on the adhesive closure part, wherein a very thin layer (<0.1 mm) is formed, one attains a better bonding to the foam material than by means of a noose-like fabric, which requires a certain expenditure of effort and thus is cost-intensive and in which the loops spatially penetrate and push forward far into the foam material. Instead of a mechanical hooking of looped or noose-like material with the foam, an adhesion to the foam material is produced by means of the individually used adhesive base and the primer layer during its production with heat and pressure, which leads to higher strength values with the desired bonding.

If the adhesive closure part under discussion is made of a polyamide material, then resorcinol, polyurethane, and post-crosslinkable polymers are used as the adhesive base. If the adhesive closure or the adhesive closure part is made of polyolefin, then polyurethane, or polymers which are post-crosslinkable are preferably used as the adhesive or primer.

If in a particularly preferred embodiment, the individual adhesive base is provided with a ferromagnetic material, then the adhesive closure part can be placed in the metal foam mold in a detachable way and is positioned in the placed site within the mold via magnetic forces. In this way, the placing of the strip-like adhesive closure part can be attained in the foaming molds in a particularly inexpensive manner.

Figure 2:
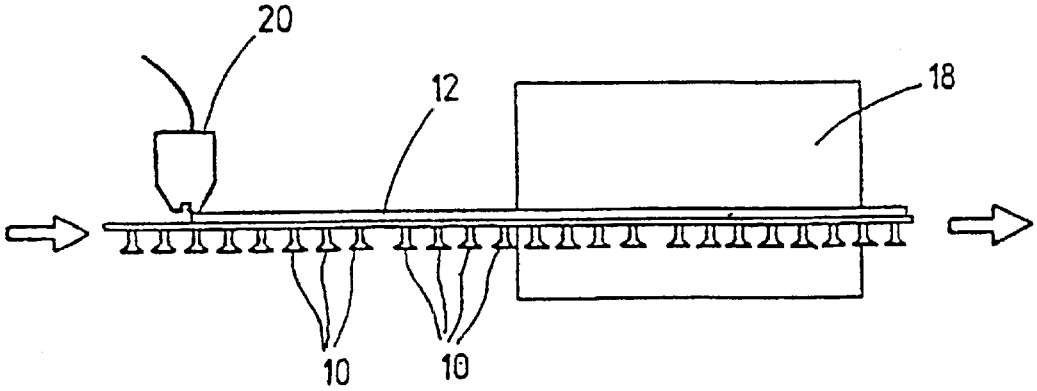
Figure 3:
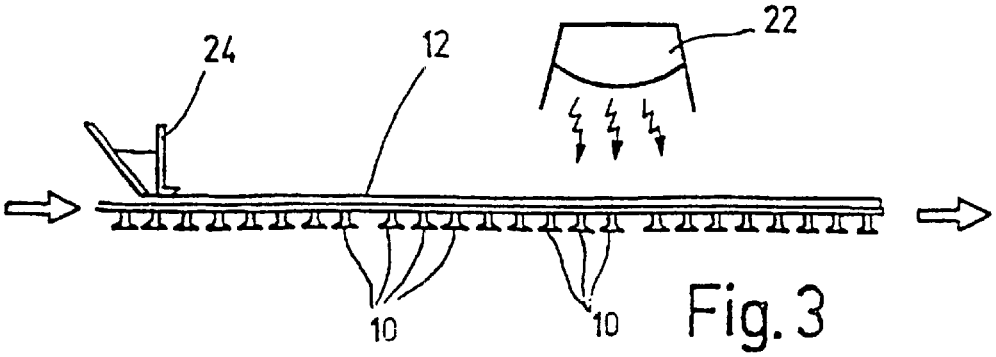

Below, the adhesive closure part is explained in more detail with the aid of various exemplified embodiments and corresponding production methods. The figures show the following, in schematic representation:

FIGS. 1–3 with in each case, an adhesive closure part having various adhesive bases and the method for the application of those adhesive bases.

The presented adhesive closure part is useful, in particular, for foaming with upholstery parts of vehicle seats (not shown) during their production. The strip-like adhesive closure part, which can also form flat configurations, has on one side, adhesive elements 10 for joining with corresponding adhesive elements of another adhesive closure part (not shown), by the formation of a common adhesive closure. The adhesive closure part shown in FIGS. 1–3 is produced by an ordinary method, as is shown for example, by DE 196 46 318.1. On the other side or on the underside of the adhesive closure part, a bonding agent 12 is provided to produce a bonding with the pertinent foam material. The bonding agent 12 consists of an applied adhesive base—that is, of a so-called primer layer.

"Adhesive bases" is the designation for adhesion-imparting media for paints or coatings. They are highly fluid and thus can be sprayed or spread. Very thin layers are produced (0.005–0.008 mm). Their adhesion-imparting effect is based thereby on the chemical reaction of their components with one another and with the individual surfaces, for example, made of metal or plastic and for this reason, the designation "reaction partner" is also common. As a rule, adhesive bases produce a varnishing layer. First coats with an adhesive-imparting effect are generally designated as primers. They are also sometimes referred to as reaction primers and are correlated with adhesive bases.

The adhesive closure part itself is made of a polyamide or a polyolefin material. Polyamide is the collective designation for high-molecular compounds which consist of components (amides) linked by peptide bonds. Common polyamides, such as PA 6 or PA66, can be used as the polyamide material. To set up the labeling system for polyamide according to ISO or DIN 16 733 T1, nylon, synonymous to polyamide, is also used as the generic designation (original trademark of DuPont for PA66). In the English-speaking area, above all, the structure-based IUPAC nomenclature is also common, for example, poly(imino-(1-oxohexamethylene)) for PA6 and poly(imino(1,6-dioxohexamethylene)iminohexamethylene) for PA 66. Because of their special characteristic, polyamides, which contain exclusively aromatic radicals (for example, those from p-phenylene diamine/terephthalic acid), are brought together under the generic designation aramide, and they are obtained on the market, for example, under the brandname Nomex. More recent developments in this field are block copolymers of polyamides with polyethers, which have both thermoplastic as well as elastomer properties.

Polyolefins are the all-embracing designation for polymers of the following general structure:

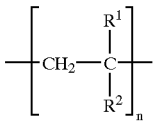

in which $R^1$ generally stands for hydrogen and $R^2$ for hydrogen, a straight-chain or branched, saturated, aliphatic or a cycloaliphatic group. Occasionally, polymers with aromatic groups, for example, the phenyl residue ($R^2=C_6H_5$, see polystyrene) are also counted among the polyolefins. Products with $R^1$=H are also designated as poly(α-olefin)s; they can be considered vinyl polymers.

Polyolefins with great industrial importance in the field of adhesive closures are, for example, polyethylenes, polypropylenes, polybutenes, which are also occasionally, erroneously, named polybutylenes or polybutenes [sic], as well as polyisobutenes and poly(4-methyl-1-pentene)s. Polymers of the higher α-olefins, for example, poly(1-hexene), poly(1-octene), or poly(1-octadecene), however, have had only very limited industrial application in this field up to now. Among the polyolefins are also copolymers of various olefins, for example, those of ethylene with propylene.

FIG. 1 refers to an adhesive closure part made of polyamide material. The adhesive base used hereby as a primer layer later enters into a strong bonding with the foam during its production by means of pressure and/or heat, via a hydrogen bridge bond and taking into consideration van der Waals forces. Furthermore, adhesive forces are active. This is understood to mean the adhesive effect between a solid interface and a second phase, which can consist of individual particles, molecules, drops, or powders, or a continuous liquid or solid film. The adhesion can be caused by electrostatic forces, by van der Waals forces (they belong to the intermolecular forces) or even by a real chemical bonding (for example, in the case of chemisorption). It is the cause of the sorption, both the adsorption on an interface as well as the absorption in an interface layer. The adhesive base consists of resorcinol and/or one of its derivatives, which can be applied, for example, from alcoholic solutions. Resorcinol or (1,3-dihydroxybenzene, 1,3-benzenediol) forms large, colorless, sweet-tasting needles and has a melting point between 109–111° [C.] and a boiling point of 280° [C.]. Resorcinol is slightly soluble in water, alcohol, for example, in the form of ethanol, ether, and glycerol and not very soluble in chloroform and carbon disulfide. In the present case, it is used as an adhesive for the polyamide material. An application roller 14, which, removing the resorcinol from a bath 16, applies it uniformly on the underside of the strip-shaped adhesive closure part, serves as the application device. In the embodiment under consideration, 70 g resorcinol in 930 g ethanol are used, wherein the adhesive closure strip is conducted along the roller 14 at the rate of 12 m per minute. For the drying process, approximately 70° C. prevails in a drying channel 18.

In the embodiment according to FIG. 2, polyurethane or a polyurethane composition is used as the adhesive base, wherein, in turn, the adhesive closure is made of a polyamide material. Polyurethanes are the all-embracing designation for polymers (polyadducts), with groups of the following type, accessible by polyaddition from two-valent and higher-valent alcohols and isocyanates:

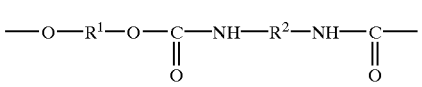

III as characteristic basic components of the base macromolecules. In many cases, polyurethanes are produced as prepolymers with terminal isocyanate groups, which cure with the use of moisture from the ambient air, with chain prolongation and perhaps crosslinking. Such prepolymers can also have a chain prolongation with diamines, forming polyurethanes, which contain urea groups. NCO-terminated prepolymers play an important role in the production of polyurethane dispersions. Depending on the selection and stoichiometric ratio of the starting substances, polyurethanes of very different mechanical characteristics are obtained, which can also be used as more or less hard elastomers in fibrous form or as polyether or polyester urethane rubber, as duroplastic cast resins (also glass fiber-reinforced) and, above all, as foams. In the application method presented in FIG. 2, the polyurethane material is applied to the underside of the adhesive closure part with the adhesion elements 10, via an application nozzle 20. A polyurethane coating method thus takes place wherein, in turn, the drying process is now carried out in the drying channel at 100° C., and the transporting rate is 6 m/min. 700 g SU-9182 from the Stahl Company are used as the coating material and 300 g Fe of the particle size <10$\mu$, as the ferromagnetic material. With the adhesive closure part produced in this way, it can be detachably affixed in metal foaming molds, by the magnetic effect of the ferro material. "Ferromagnetics" is the designation for such magnetic materials which exhibit ferromagnetism, wherein the magnetization begins under the influence of an external magnetic field. Only at temperatures below the Curie temperature is a substance ferromagnetic, wherein nowadays, elements such as iron, cobalt, nickel, and alloys of these components (Heusler alloys) are usually counted among the ferromagnetics.

The embodiment according to FIG. 3 refers to an adhesive base made of polymers, which are formed by means of a post-crosslinking, for example, via irradiation by means of a UV-lamp 22 of curable resins, such as epoxide compounds. The curing via ionizing rays is also designated as lacquer curing. In particular, epoxy resins can be used well as curable resins. In lacquer curing, therefore, the curing of adhesive bases or primers, applied in the liquid state, is carried out to form surface layers. Polymerizable lacquer systems can be cured with ultraviolet irradiation or other ionizing irradiation. For UV crosslinking with UW lamps 22, mercury discharge lamps are usually used as light sources, which are suitable, among other things, for acrylic lacquers and certain polyester lacquers also. Lacquer curing by electron beams (ESH, EBC) can polymerize monomer-containing lacquers to form hard resistant films. The polymerization takes place in fractions of seconds.

In the embodiment under consideration, 873 g of the material sold under the brandname UVacure 1534 are used as the epoxy resin composition, and 97 g tripropylene glycol and 30 g FX-5 12. The application takes place with a doctor device 24 and the belt speed is 8 m/min for the adhesive closure part. The ultraviolet lamp 22 produces 120 W/cm$^2$.

If the pertinent adhesive closure part is made of a polyolefin material, then it can be coated with the method in accordance with FIGS. 2 and 3. In this respect, the statements made in the preceding are also valid for such a polyolefin closure.

What is claimed is:

1. An adhesive closure part for foaming with upholstery parts of vehicle seats during their production comprising a substrate with a plurality of adhesive elements on one side thereof for joining with corresponding adhesive elements of another adhesive closure part, with the formation of an adhesive closure and with a bonding agent on the other side of said adhesive closure part for producing a bonding with the pertinent foam material, wherein the bonding agent is made of an adhesive base, applied on said other side of the adhesive closure part and wherein the adhesive closure part is made of a polyolefin material, wherein the adhesive base is polyurethane or a polymer, which is formed by means of a crosslinking of a curable resin.

2. The adhesive closure part according to claim 1, characterized in that the curable resin is an epoxy resin.

3. The adhesive closure part according to claim 2, characterized in that the adhesive base is applied flat in a thin uniform layer, via a spreading device, a spraying device, or a doctor blade.

4. The adhesive closure part according to claim 2, characterized in that the pertinent adhesive base is provided with a ferromagnetic material.

5. The adhesive closure part according to claim 2, characterized in that its adhesive elements consist of individual adhesive heads, which are shaped flat on the head side and have equivalent heights.

6. The adhesive closure part according to claim 2, characterized in that it is shaped as a continuous strip or surface material.

7. An adhesive closure part for foaming with upholstery parts of vehicle seats during their production comprising a substrate with a plurality of adhesive elements on one side thereof for joining with corresponding adhesive elements of another adhesive closure part, with the formation of an adhesive closure and with a bonding agent on the other side of said adhesive closure part for producing a bonding with the pertinent foam material, wherein the bonding agent is made of an adhesive base, applied on said other side of the adhesive closure part and wherein the adhesive closure part is made of a polyamide, wherein the adhesive base, is made of resorcinol, a derivative of resorcinol, or resorcinol and at least one of its derivatives.

8. The adhesive closure part according to claim 7 or 1, characterized in that the adhesive base is applied flat in a thin uniform layer, via a spreading device, a spraying device, or a doctor blade.

9. The adhesive closure part according to claim 7 or 1, characterized in that the pertinent adhesive base is provided with a ferromagnetic material.

10. The adhesive closure part according to claim 8, characterized in that the pertinent adhesive base is provided with a ferromagnetic material.

11. The adhesive closure part according to claim 7 or 1, characterized in that its adhesive elements consist of individual adhesive heads, which are shaped flat on the head side and have equivalent heights.

12. The adhesive closure part according to claim 8, characterized in that its adhesive elements consist of individual adhesive heads, which are shaped flat on the head side and have equivalent heights.

13. The adhesive closure part according to claim 9, characterized in that its adhesive elements consist of individual adhesive heads, which are shaped flat on the head side and have equivalent heights.

14. The adhesive closure part according to claim 7 or 1, characterized in that it is shaped as a continuous strip or surface material.

15. The adhesive closure part according to claim 8, characterized in that it is shaped as a continuous strip or surface material.

16. The adhesive closure part according to claim 9, characterized in that it is shaped as a continuous strip or surface material.

17. The adhesive closure part according to claim 11, characterized in that it is shaped as a continuous strip or surface material.

* * * * *